United States Patent [19]

Ohlsson et al.

[11] Patent Number: 4,741,713

[45] Date of Patent: May 3, 1988

[54] BOAT PROPELLER DRIVE UNIT

[75] Inventors: Lars-Erik Ohlsson, Hisings Kärra; Ulf Soderbaum, Skarhamn; Kjell Borgersen, Hjalteby, all of Sweden

[73] Assignee: AB Volvo Penta, Gothenburg, Sweden

[21] Appl. No.: 908,506

[22] Filed: Sep. 17, 1986

[30] Foreign Application Priority Data

Sep. 19, 1983 [SE] Sweden ..... 8305027

[51] Int. Cl.[4] ..... B63H 5/12

[52] U.S. Cl. ..... 440/53; 440/2

[58] Field of Search ..... 440/1, 2, 53, 57; 114/144 R, 144 E; 324/208; 340/689, 984, 987

[56] References Cited

U.S. PATENT DOCUMENTS 3,136,287 6/1964 North ..... 440/57

4,364,733 12/1982 Lohner ..... 440/2

4,624,643 11/1986 Ohlsson et al. ..... 440/2

*Primary Examiner*—Joseph F. Peters, Jr.

*Assistant Examiner*—Edwin L. Swinehart

*Attorney, Agent, or Firm*—Young & Thompson

[57] ABSTRACT

A boat propeller drive unit of the inboard-outboard type, having a portion securely mounted in an opening in a boat transom and adapted to be drivingly connected to a motor inboard of the transom, and having a propeller leg disposed outboard of the transom. This leg is adjustable to various angles in relation to the transom by tilting about a horizontal axis and is pivotable about an upright steering support. The drive unit comprises an inductive sensor connected to a wire passing through a central bore of the steering shaft, and a magnetic core fixedly attached to the propeller leg. The magnetic core has magnetic areas separated by non-magnetic areas, and when the magnetic core is moved under the sensor, the sensor functions as a pulse counter to count a pulse of each magnetic area is moved under it. The sensor thus provides an output signal depending on the tilting angle relative to the transom, which signal indicates that angle.

2 Claims, 4 Drawing Sheets

BOAT PROPELLER DRIVE UNIT

The present invention relates to a boat propeller drive unit of the type which has a portion mounted in an opening in a boat transom and designed to be drivingly connected to a motor placed inboard of the transom and a propeller leg disposed outboard of the transom, said leg being adjustable to various angles in relation to the transom by tilting about a horizontal axis and pivotable about a steering shaft lying in a vertical plane, said drive unit comprising means for providing to an instrument an output signal dependent on the tilting angle relative to the transom, which signal indicates said angle.

Boat propeller drive units of this type, so-called inboard-outboard drive units, can be tilted or trimmed to various angles in relation to the transom to adapt the angular setting of the drive unit to the cruising attitude of the boat in the water. These drive units can also be tilted up so that the propeller housing is raised out of the water. Certain inboard-outboard drive units are provided with an electrical sensor which is coupled to a position indicator instrument on the instrument panel of the boat, whereby the trim/tilt angle can be read. In previously known designs of this type, the electrical sensor is placed at the tilt axis. This creates problems however due to the fact that the tilt axis is located outside the transom. The environment for electrical components is thus the worst imaginable placing very high demands on careful sealing of both the sensor itself and the electrical wires to the sensor which must pass through the transom.

The purpose of the present invention is to achieve a boat propeller drive unit of the type described by way of introduction, which removes the disadvantages of known trim/tilt angle sensors.

This is achieved according to the invention by virtue of the fact that said means comprise a signal emitter spaced from the tilt axis and having means extending through the steering shaft and cooperating with the position sensor, which is joined to the propeller leg and extends in a circular arc having the tilt axis as its center, in order to actuate the signal emitter to send a signal dependent on the tilting angle of the propeller leg.

The advantage of the arrangement according to the invention is that the signal emitter can be placed in a location where it is well-protected against splashing water, namely inside the shield which acts as the drive unit mounting in the transom and through which the steering shaft extends. As a result, no wires need be drawn through the transom.

The invention will be described in more detail with reference to an example shown in the accompanying drawings, in which.

Figure 1:
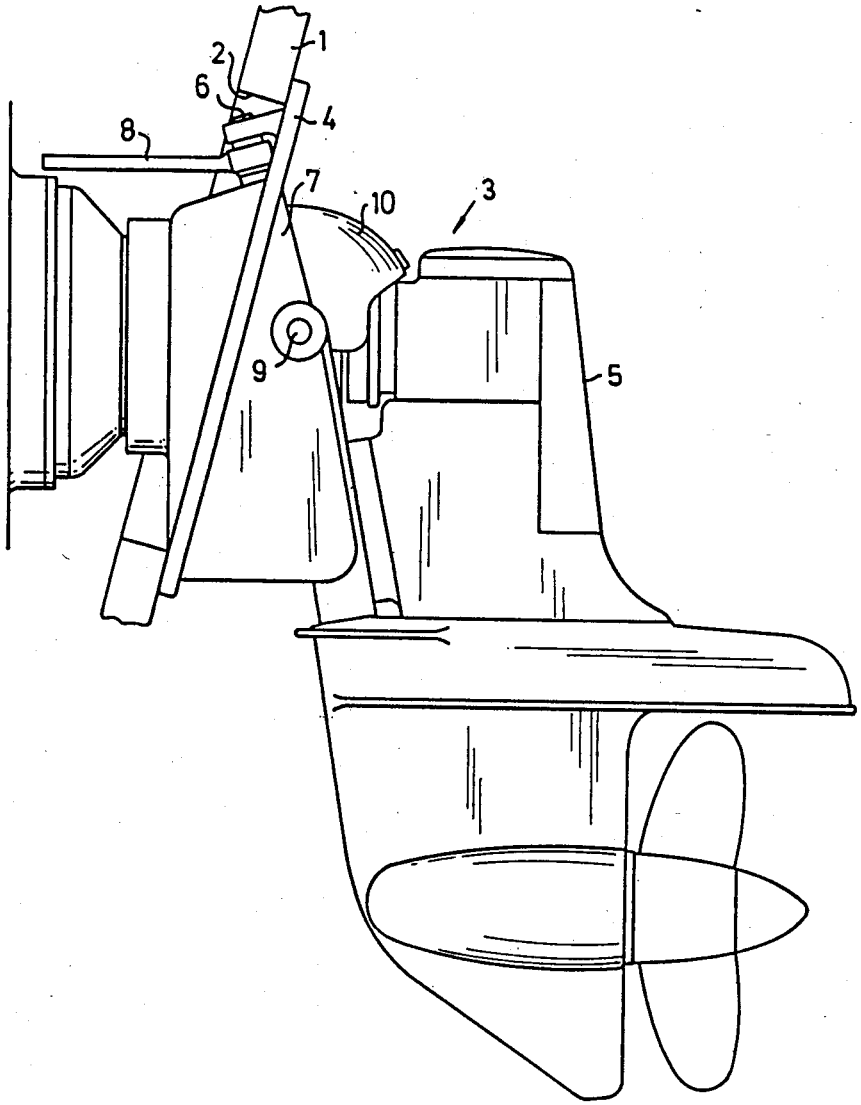
FIG.1 PRIOR ART
FIG. 1 shows a side view of a known outboard drive unit.

In FIG. 1, 1 designates the transom of a boat with an opening 2 in which an outboard drive unit 3 is mounted in a conventional manner and which is covered on the outboard side by a shield 4 on the drive unit. The drive unit has a propeller leg 5 which is supported by the shield 4. A steering shaft 6 with a fork 7 is mounted in the shield and is joined to a steering arm 8 which is to be connected to the steering controls of the boat. The tines of the fork 7 are provided at their outer ends with pins 9 on which the helmet 10 is pivotally mounted. The helmet 10 covers the drive shaft joints and is joined to the propeller leg 5 to transmit the rotation of the steering shaft to the propeller leg.

Figure 2:
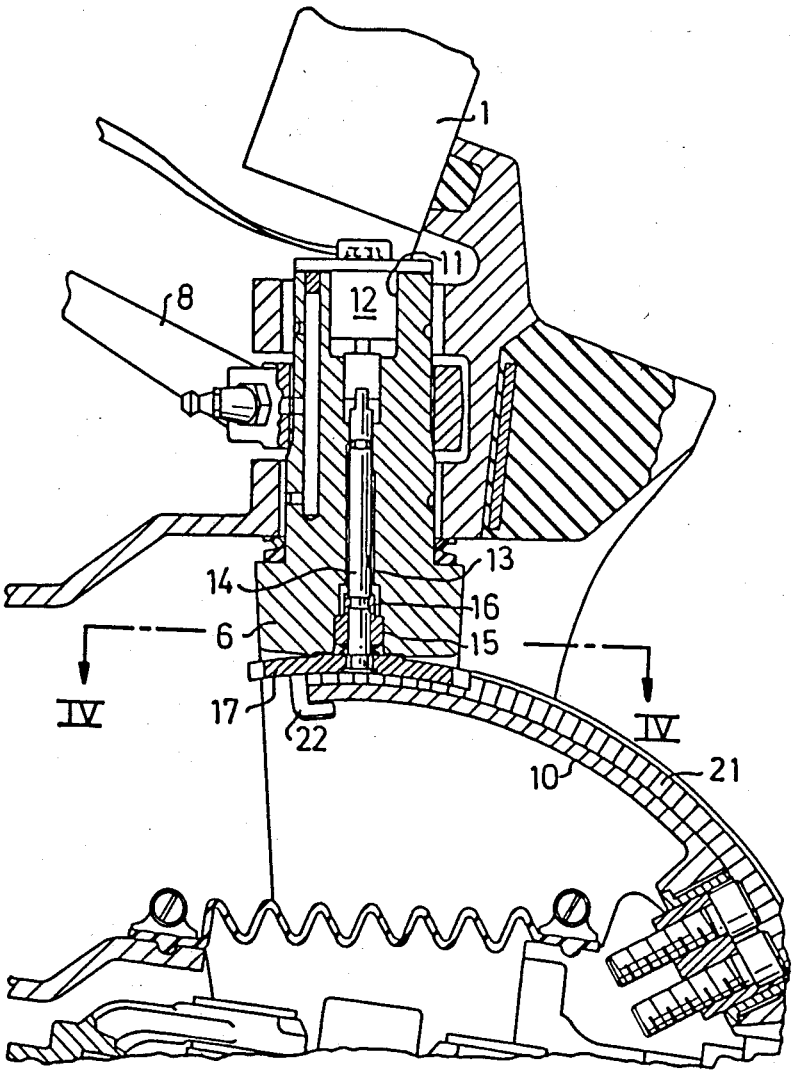
FIG. 2 shows a longitudinal section through the steering shaft and helmet of a drive unit according to the invention.
Figure 3:
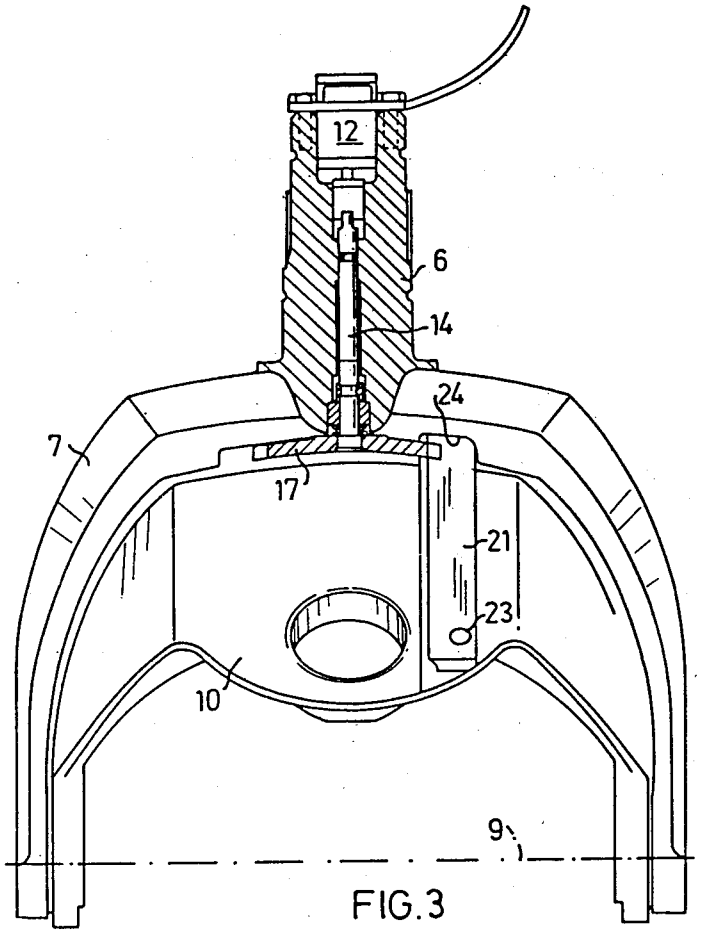
FIG. 3 shows a frontal view, partially in section, of the steering shaft and the helmet.

According to the invention, the steering shaft 6 is provided at its upper end with a central recess 11 in which a signal emitter 12 in the form of a rotary potentiometer is mounted (FIGS. 2 and 3). From the recess 11, a central through bore 13 extends in which a shaft 14 is rotatably mounted in a bearing 15 using a snap ring 16 which fixes the shaft axially. The shaft 14 is in engagement at its upper end with the potentiometer 12. At its lower end, the shaft supports a gear 17 which is made of plastic and is fixed to the shaft by force fitting. Thus, turning the gear 17 can vary the signal from the potentiometer.

Figure 4:
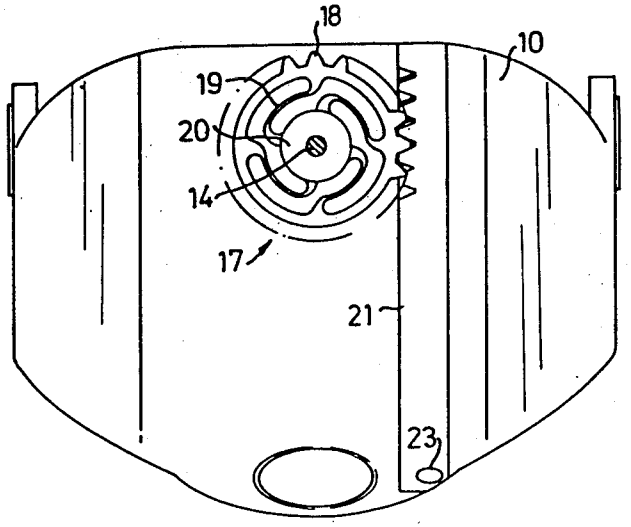
FIG. 4 shows a view along the line IV—IV in FIG. 2.

The gear 17 has a toothed rim 18 which is joined via thin, curved spokes 19 to a hub 20 (FIG. 4). The teeth of the rim 18 engage the teeth of a toothed segment 21 which is fixed to the helmet 10 and is adapted to the shape of the helmet, i.e. to a circular arc with the tilt axis as its center. When the propeller leg is tilted, the toothed segment 21 will thus rotate the gear 17 and thus change the setting of the potentiometer. The potentiometer can be of high resistance (1 kΩ), have no mechanical stop, and have an electrical rotational angle of 320°.

The toothed segment 21 has at one end a hook 22 which grasps around one edge of the helmet. At its other end, the toothed segment has a pin 23 which is inserted into and locked in a hole in the helmet. Lateral movement of the toothed segment is controlled by a groove 24 in the fork 7. The toothed segment is disposed in relation to the gear so as to produce a certain amount of pretension in the spokes, to compensate for normal play in the system and missed margins of tolerance, and in all cases assure tooth engagement without play. In the embodiment described, the toothed segment follows the up and down movements of the helmet without play, and the lateral movement of the helmet caused by the steering forces do not affect the toothed engagement.

In the embodiment described, the ratio between the angles of the propeller leg and the potentiometer is 1:4.6, which gives the potentiometer high definition. The embodiment according to the invention provides a device which is simple to calibrate; one need only loosen the mounting of the potentiometer and turn it.

Figure 6:
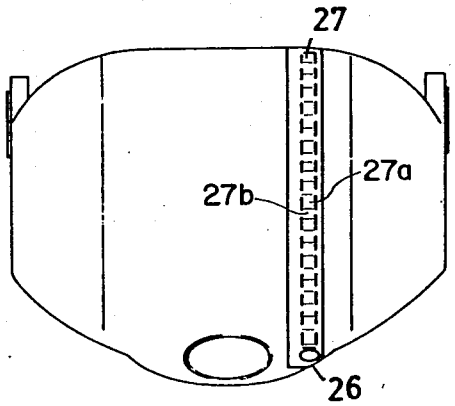
FIG. 6 shows the arrangement of the magnetic core on the leg.
Figure 5:
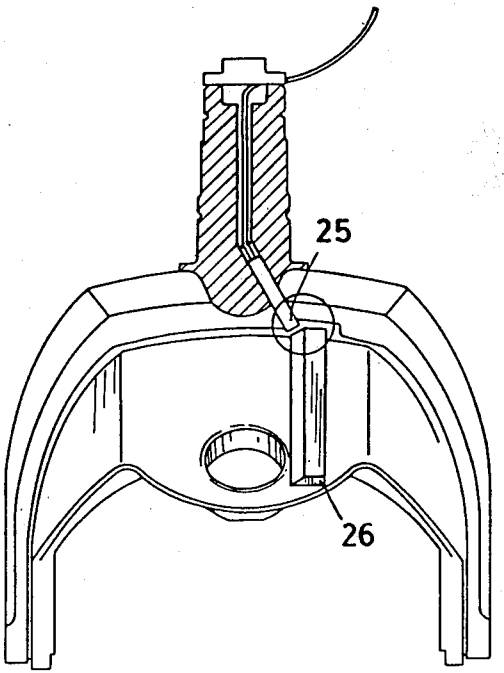
FIG. 5 shows a frontal view of the steering shaft and helmet with the inductive sensor and lead in the central bore.

As shown in FIG. 5, a wire lead is led down through bore 13 and is connected to the inductive sensor 25. Near the bottom, the bore is inclined on the side so that the inductive sensor is inserted at a small angle with the central bore. The sensor is located so as to be near element 26 which contains at its center a magnetic core 27 as shown in FIG. 6. The core is comprised of a circular bar and has magnetic areas 27*a* separated by non-magnetic areas 27*b*. Since element 26 is rigidly attached to the leg 5, as the leg 5 is moved, element 26 and the magnetic core 27 are moved in relation to the fork 7 and thus are moved with respect to the inductive sensor 25 which is stationary on the fork. As the core is moved, the inductive sensor counts the pulses created by the successive movement of the magnetic area 27*a* and the non-magnetic areas 27*b* as they pass each other.

The pulses counted by the inductive sensor are fed to electronic equipment which has indicator means for displaying the trim angle and thus the inductive sensor provides an output signal depending on the tilting angle relative to the transom, which indicates that angle. If the trim angle starts at zero, as the leg is tilted to a certain trim angle, the number of pulses are counted and a corresponding angle is displayed. As the leg is moved back toward a zero trim angle position, there is a polarity reversal of the servo equipment of the drive leg and therefore a successively decreasing reading is displayed. The sensing means of course has an electronic circuit which includes a memory function. The electronics of the circuit and the display as such do not form a part of this invention and are well within the ability of one skilled in the art to construct.

Other conceivable embodiments within the scope of the invention are also possible. For example, a cam curve on the helmet can cooperate with a rod which slides in the shaft to set a potentiometer, or an inductive sensor can cooperate with a magnetic strip on the helmet.

What is claimed is:

1. In a boat propeller drive unit of the type which has a portion securely mounted in an opening in a boat transom and designed to be drivingly connected to a motor inboard of the transom, and a propeller leg disposed outboard of the transom, said leg being adjustable to various angles in relation to the transom by tilting about a horizontal axis and pivotable about an upright steering shaft, said drive unit comprising means for providing an output signal depending on the tilting angle relative to the transom, which signal indicates said angle; the improvement in which said means comprises an inductive sensor connected to a wire passing through a central bore of the steering shaft and a magnetic core fixedly attached to the propeller leg.

2. Boat propeller drive unit according to claim 1, wherein said magnetic core has magnetic areas separated by non-magnetic areas, and when said magnetic core is moved under said sensor, said sensor functions as a pulse counter to count a pulse as each magnetic area is moved under it.

* * * * *